United States Patent [19]

Rose

[11] 4,247,959

[45] Feb. 3, 1981

[54] ANTICHAFE LOWER UNDERGARMENT FOR WOMEN

[76] Inventor: Esther E. Rose, 56 W. 65th St., New York, N.Y. 10018

[21] Appl. No.: 138,310

[22] Filed: Apr. 8, 1980

[51] Int. Cl.[3] ..... A41D 27/26

[52] U.S. Cl. ..... 2/212

[58] Field of Search ..... 2/221, 213, 71, 72, 2/73, 74, 69, 224, 400, 243 R, 243 B

[56] References Cited

U.S. PATENT DOCUMENTS

| | | | |
|---|---|---|---|
| 2,574,861 | 11/1951 | Cooley | 2/224 |
| 2,665,428 | 1/1954 | Bowley | 2/212 |
| 3,066,308 | 12/1962 | Ertezek | 2/212 |
| 3,164,843 | 1/1965 | Erteszek | 2/212 |

*Primary Examiner*—Doris L. Troutman

*Attorney, Agent, or Firm*—William T. Hough

[57] ABSTRACT

In a preferred embodiment, a novel undergarment combining advantages of panties and a half-slip, constructed with a narrow crotch width between inner panel sections that become positioned between the legs, formed by seaming-together of precut panels of undergarment knit fabric of which left and right panels are mirror-images of each other, and forward and rearward portions being also substantially similar in shape except for rear additional fullness.

10 Claims, 8 Drawing Figures

ANTICHAFE LOWER UNDERGARMENT FOR WOMEN

This invention relates to a novel anti-chafe woman's undergarment having special simplified low cost construction.

BACKGROUND TO THE INVENTION

Heretofore, there has been no satisfactory, cool garment to be worn under a skirt that will avoid or prevent leg chaffing. Garments characterized by functioning as a slip and pantie combination have been either too loose fitting, or too wide, in the crotch, or have been too straight and form-fitting, devoid of flexibility in the waistline. Tyical of such wide-crotch fabric structures are garments as illustrated in prior art U.S. Pat. Nos. 3,066,308 and 3,164,843 and 2,665,428. Additionally, the prior art patents are of complicated construction and costly to manufacture. For example, the above-noted U.S. Pat. No. 3,066,308 requires bands of facing along the front slit to the body fabric along the opposed edge portions of the front split, and it hangs straight against the body instead of flaring and is thus devoid of freedom of movement. Likewise, the garment of U.S. Pat. No. 3,164,843 is form-fitting, and requires seams along the slit, and also requires a rear slide fastener, which fastener has a disadvantage in removal for sanitary purposes. Similarly the skirt of U.S. Pat. No. 2,665,428 is form-fitting and has a bulky and large crotch construction, as well having complicated construction certainly not conducive for use as an undergarment. Another tight form-fitting women's petticoat is shown in U.S. Pat. No. 2,574,861, composed of many panels of diverse specific shapes devoid of freedom of movement.

Either or both lack of freedom of movement resulting from tightness of the surrounding fit of the garment or the largeness of the crotch construction can contribute to chaffing when such garments are worn by women having fat or large thighs. The noted prior art patents are characterized with structures that would thus contribute to, rather than avoid chaffing of the woman's plump legs.

BROAD DESCRIPTION OF THE INVENTION

Accordingly, objects of the invention include the obtaining of a womens lower undergarment in the nature of combined panties and half-slip, obviating and avoiding difficulties and disadvantages of the heretofore available women's undergarments, such as typified by the above-noted prior art patents, for example.

Another object is to obtain an antichafe undergarment that serves the functions of women's panties and half-slip simultaneously of a type suitable particularly for women having oversized or fat legs or thighs.

Another object is to obtain a womens antichafe undergarment of simple construction and from minimal numbers of panels and from basic specifically-shaped panels of a particular type of fabric, to result in economic manufacture and low cost and sales prices.

Another particular object of the invention is to obtain a novel ladies underware lower garment formed in a manner to fit the crotch snugly and simultaneously not to crowd the minimal space available, and accordingly to prevent the legs from contacting one-another to thereby avoid leg or garment-leg chaffing in hot weather by continuous rubbing during walking. Likewise, freedom of movement must be achieved to avoid a binding and thus irritating chaffing of the skin. It is an object to obtain fullness of the leg openings to allow for ventilation to the crotch area while concurrently providing proper crotch concealment essential for ladies wear, and while simultaneously providing body freedom and comfort for each of sitting, standing, or walking or running conditions such as encountered particularly during engagement in sports activities requiring substantial exercise and movement.

Another object is to obtain such an undergarment which while providing ventilation and allowing the wearer to feel cooler in hot weather when worn alone, will simultaneously inhibit wind and is of a nature that can be worn on top of other clothing of an underware type such as panties, corset or the like.

Another object is to utilize a type of undergarment fabric of a nature unlikely to cause chafe when rubbed between plump or fat or oversized legs, and which together with the special design of panels and panel portions of the garment of this invention, have a minimum of potentially-chaffing seams.

Another object, together with the particular fabric utilized therewith, is to obtain a combination that avoids undue stretching which stretching in and of itself is susceptible to causing sagging particularly in the crotch to expose opposing legs' fatty tissue to contact with each other with a resulting chaffing.

Another object, together with above-noted desire to achieve savings in cost, is to obtain an antichafe undergarment design by which efficient use of fabric materials.

Likewise, for the fat or plump or oversized lady, it is an object to obtain an antichafe garment having also a non-bulky waist construction of limited but sufficient stretch to allow for ease of putting on and removing the garment, together with associated construction of large leg holes and the use of the particular fabric preferred for the present invention.

Other objects become apparent from the preceding and following disclosure.

One or more objects of the invention are obtained by the invention as typically illustrated by the accompanying drawings of preferred embodiments given for purposes of enhancing a proper understanding of the invention while such illustrated embodiments are not intended to unduly limit scope of the invention.

Broadly the invention may be described as an antichafe lower undergarment for women, by virtue of its construction and design of the panel and panel portions achieves the above-noted objects, as follow. It is a composite of basically four panels or panel portions, noting that there may be two separate bilateral panels which include front and back panel portions in contrast to a preferred embodiment having two front panels and two rear panels. Either way, the left front and the left rear panels or panel portions are mirror images of the right front and right rear panels or panel portions. There are other elements in combination in preferred embodiments, to make a more complete and better functioning final garment better achieving the objects of the invention. For convenience of description, the panels and panel portions shall be referred to as front and rear and as left and right panels as illustrated in the drawings, in a front view the left panel or panel portion being to the left of the drawing and the right panel or panel portion being to the right of the drawing; likewise, the front panels or panel portions will be at the lower portion of the drawing of a perspective front view, and the rear portion or panel will be at the upper portion of the drawing of a perspective front view. A left edge of a panel or panel portion will be to the left of the drawing, and a right edge will be to a right edge of the drawing. The panel or panel portion top will be at the top of a drawing and the bottom will be at a bottom of the drawing.

Accordingly, the preferred embodiment includes four panels in the nature of first and second pairs of panels, the first pair being front first and second panels that in fact are front left and front right panels that are mirror images of each other. In like manner, the second pair is rear third and fourth panels as rear left and rear right panels that are mirror images of each other. The front first panel has substantially similar shape as that of the rear third panel, with the exception of a cut allowing greater fullness for the buttocks as shall be noted below. Likewise, the front second panel has substantially similar shape as that of the rear fourth panel, except likewise for greater fullness for the rear panel for the buttocks.

The method of making is inherent in the construction as defined by the manner in which the several panels are joined together at different points as follow. As above noted, each panel has a top and a bottom. Each of the front first panel and the rear third panel have first right and first left upright seam edges. Each of the front second panel and the rear fourth panel have second right and second left upright seam edges. The front first panel and the rear third panel each have first and second concavely-shaped arcuate edges extending between an upper portion of said first right upright seam edge and said top of said front first panel and extending between an upper portion of said second right upright seam edge and said top of said rear third panel respectively; and said front second panel and said rear fourth panel have each third and fourth concavely-shaped arcuate edges extending between an upper portion of said second left upright seam edge and said top of said front second panel and extending between an upper portion of said fourth left upright seam edge and said top of said rear fourth panel. Each of said first, second, third and fourth concavely-shaped arcuate edges are joined together along their lengths as a first seam that extends from a front centerline point at the waist level to a rear centerline point at the waist level. The front second panel's second left edge and the rear fourth panel's second edge are seamed together along their lengths as a second seam, and the first and third concavely-shaped arcuate edges are seamed together along their lengths as a third seam, with likewise the second and fourth concavely-shaped arcuate edges being seamed together along their lengths as a fourth seam. The front first panel's first left upright seam edge and the rear third panel's first left upright seam edge are seamed together along their lengths as a fifth seam, and the front second panel's second right upright seam edge and the rear fourth panel's second right upright seam edge are seamed together along their lengths as a sixth seam. From the above-noted centerline point at each of the front and the back, at the upper-most location of each of said third seam and said fourth seam, there are—as is well known conventionally in the garment and dress-making trade—imaginary lines extending downwardly vertically along the worn dress, for example, or slip or half-slip, and the like, along a surface of the panels; this imaginary line is known as the center lines front and back. There are accordingly here first, second, third and fourth centerlines respectively for each of the first, second, third and fourth panels respectively. The importance of identifying such centerline lies in the custom and necessity of defining the lay of the fabric as cut, with regard to or relative to the centerline of the particular panel or panel portion, as the case may be.

Accordingly, in accord with conventional definition in the trade, the first, second, third and fourth panels in this preferred embodiment are each cut at an angle ranging from about 105 degrees to about 125 degrees off grain of the undergarment knit fabric—the fabric of this invention being entirely and necessarily limited to undergarment knit fabric. The above-noted range in degrees is critical to the proper functioning of this inventive garment with regard to stretch and the like. A more preferred range obtaining by far more optimal results is from about 110 degrees to about 120 degrees. However, in an alternate embodiment, but with less optimal results, the cut of the fabric, with regard to the wale, may be at substantially zero degree—referred to as being on the straight. The above-noted cut at an angle of for example at 115 degrees is termed as on the bias, also with regard to the wale of the fabric. There of course may be accepted very minor variations off of the straight, above-referred to, plus or minus.

Preferably there is included a reinforcing tape extending over the seam lines of the third seam and of the fourth seam, seamed thereto. This obviates undue stretching which could ultimately lead to a sagging crotch area with an accompanying loss of antichafe benefits.

Also, preferably as above-noted, the third and fourth concavely-shaped arcuate edges are of greater lengths than the first and second concavely-shaped arcuate edges, thereby providing for greater fullness in the rear panels allowing for buttocks room and thereby further avoiding binding in the crotch by greater room for flexibility when worn.

As previously noted, there is another embodiment in which there are bilaterally merely two basic panel, of which each includes front and rear panel portions; in essence, as compared to the above-described preferred embodiments, the preferred embodiments front first panel's front left upright seam edge and the rear third panel's rear left upright seam edge have been eliminated in this embodiment by being already unified as originally cut from the undergarment fabric; likewise, the preferred embodiment's front second panel's front right upright seam edge and the rear fourth panel's rear right upright seam edge have been eliminated in this embodiment by being already unified as originally cut from the undergarment fabric. Thus, in this less-preferred embodiment, the first panel of this embodiment includes first and third panel portions folded-over in semicircular form with the third panel portion located substantially behind the first panel portion; likewise, the second panel includes second and fourth panel portions folded-over in semicircular form with the fourth panel portion located substantially behind the second panel portion. The first and second panels are mirror-images of each other in shape. The first and second panel portions are front panel portions, and the third and fourth panel portions are rear panel portions. The front first panel portion and the rear third panel portion respectively each have a front right and a rear right upright edge respectively. The front second panel portion and the rear fourth panel portion respectively have a front left and a rear left upright seam edge respectively. The front first panel portion and the rear third panel portion each have first and second concavely-shaped arcuate edges extending between an upper portion of said front right upright edge and said top of said front first panel portion, and extending between an upper portion of said rear right upright edge and the top of the rear third panel portion respectively; and the front second panel portion and the rear fourth panel portion have third and fourth concavely-shaped arcuate edges extending between an upper portion of the front left upright edge and the top of the front second panel portion, and extending between an upper portion of the rear left upright edge and the top of the rear fourth panel portion. Each of the first, second, third and fourth concavely-shaped arcuate edges are joined together at a lower end of each thereof, and the front first panel portion's right edge and the third panel portion's rear right edge are seamed together along their lengths as a first seam. Likewise, the front second panel portion's front left edge and the rear fourth panel portion's rear left edge are seamed together along their lengths as a second seam. The first and third concavely-shaped arcuate edges are seamed together along their lengths as a third seam, and the second and fourth concavely-shaped arcuate edges are seamed together along their lengths as a fourth seam.

For all embodiments, it is important that the panels, or panel portions, as the case may be, to be a full flared skirt in order to get preferred antichafe maximal benefits. Thus, for the bilateral two panel embodiment having each with front and rear panel portions, the widths of the respective panels and panel portions thereof are sufficiently larger at the bottom than at the top, that a full flared skirt exists preferably, thereby providing a fullness of drape when worn by the wearer.

Likewise, for the four-panel preferred embodiment, the widths of the first, second, third and fourth panels respectively are sufficiently larger at the bottom than at the top thereof, that a full flared skirt exists preferably, thereby providing a fullness of drape when worn by the wearer.

THE FIGURES

FIG. 1A, FIG. 1B, FIG. 1C all represent and illustrate graphically and diagrammatically a preferred embodiment of the present invention.

Figure 1A:
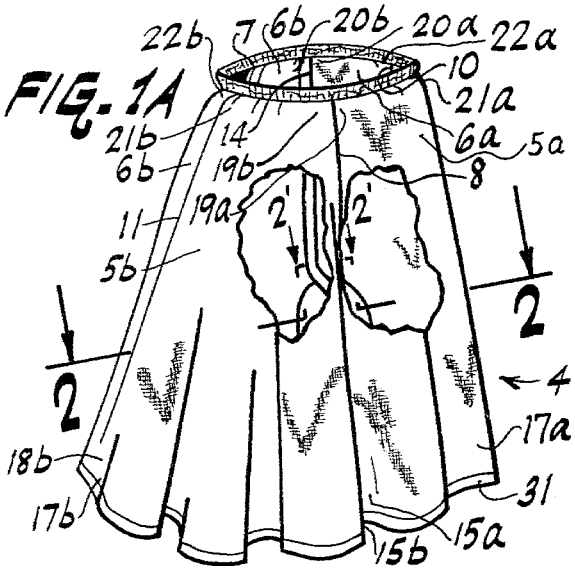
FIG. 1A illustrates a front perspective view of the preferred antichafe lower undergarment for women, with cut-away.
Figure 1B:
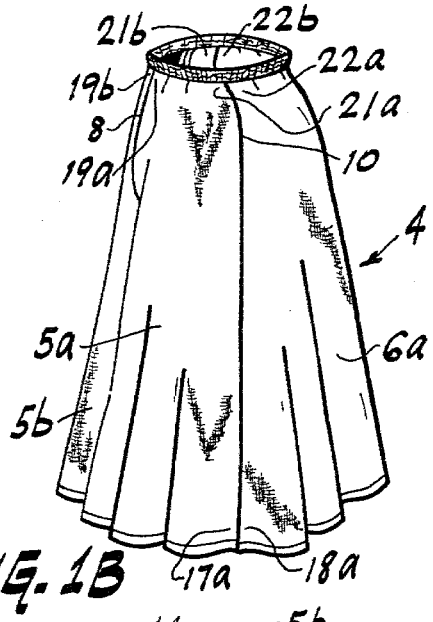
FIG. 1B illustrates a side perspective view of the preferred antichafe lower undergarment for women.
Figure 1C:
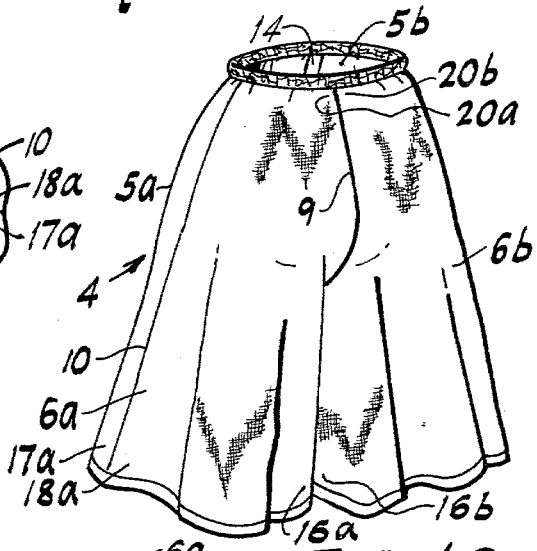
FIG. 1C illustrates a rear perspective view of the preferred antichafe lower undergarment for women.
Figure 3:
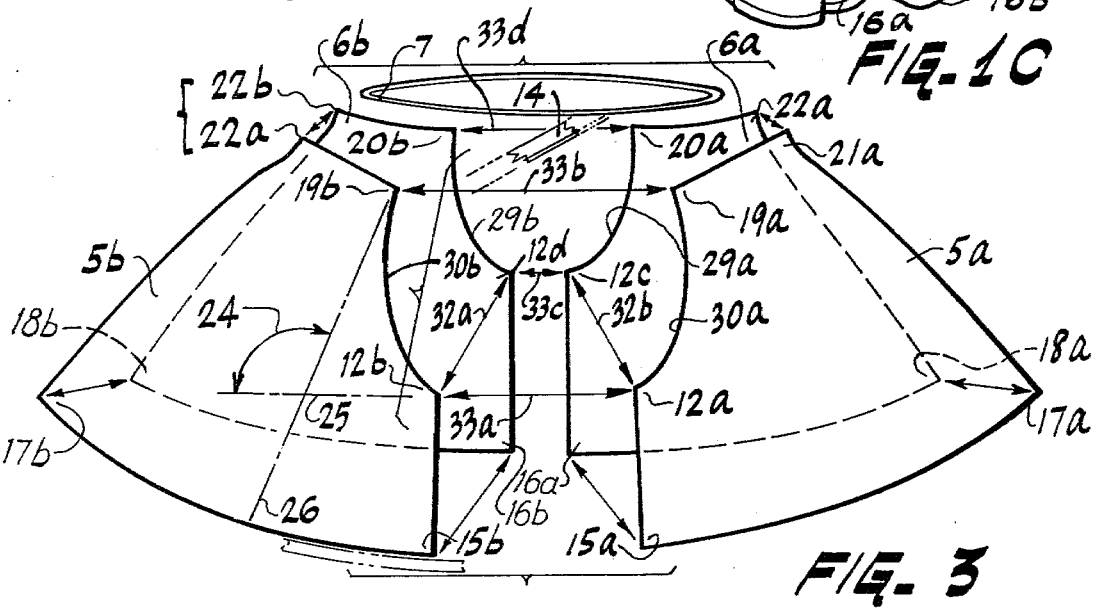
FIG. 3 illustrates an exploded view of the antichafe lower undergarment of FIG. 1, into its separate panels and other elements, in a front view thereof somewhat in perspective view.
Figure 1B:
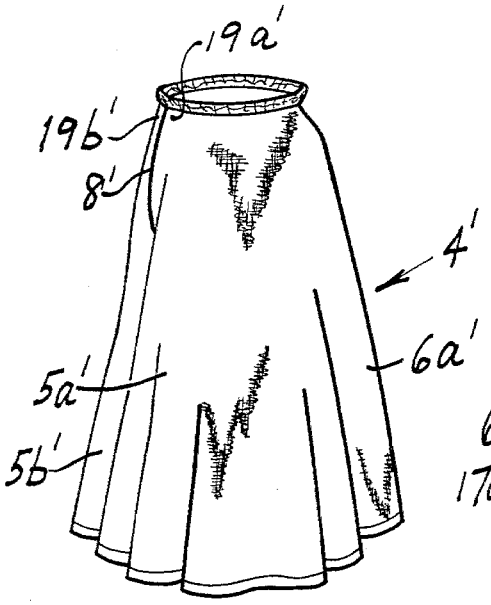
Figure 1C:
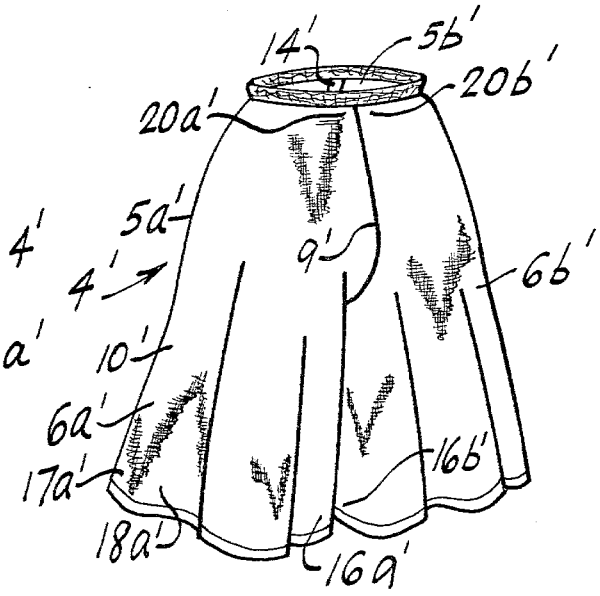
Figure 3:
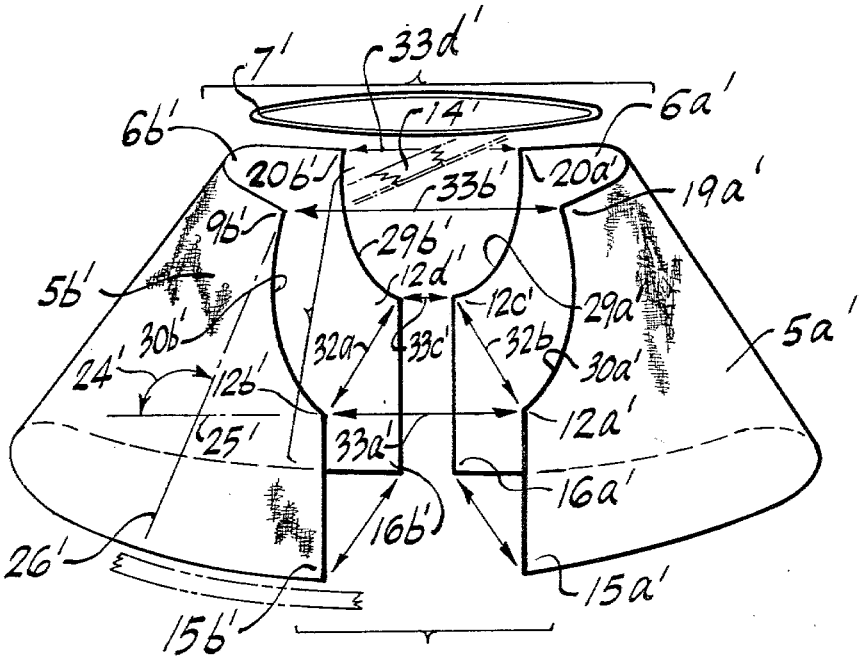

FIG. 1B', FIG. 1C' and FIG. 3' correspond to the types of illustrations of FIGS. 1B, 1C and 3, except that for FIGS. 1B', 1C' and 3' there is illustrated a less-preferred embodiment having solely two basic bilateral panels each of which has front and rear panel portions.

Accordingly, FIG. 1B' illustrates a side perspective view of this embodiment, FIG. 1C' illustrates a rear perspective view of this embodiment, and FIG. 3' illustrates an exploded view of this embodiment, in a front view thereof somewhat in perspective view.

DETAILED DESCRIPTION OF THE INVENTION

The antichafe lower endergarment for women of this invention is made of a stretchable, smooth, slip-type fabric and has a configuration that allows a close fit around the waist with sufficient elasticity so that no bulky zipper closure is required for the garment to be easily slipped on or off, a convenience for sanitary purposes. It provides the wearer with a continuous comfortable waist and hip fit regardless of considerable variation in daily waist measurements, or in an increase or decrease of overall weight of several pounds. It is particualarly suited to, but not limited to, the woman with a full figure, the panels of which drape from the form-fitting waist in a flared manner that is flattering to the female figure.

The present garment as constructed makes efficient use of material and requires a minimum number of seams, thus reducing cost of materials and labor in construction, and making it thus economical to produce in quantity, i.e. on a large scale of production.

To keep the garment from stretching downward, particularly when the panels are cut on the bias, the above-noted reinforcing tape is included preferably in the seams of the front and back arcuate edges. The inner leg edges will normally stretch downwardly slightly and this is sufficiently overcome by shortening the hemline at the inner leg seam so that it will stretch down to conform to the rest of the hem after wearing.

By reason of the design and structure, this garment has a number of advantages in providing a waist that fits with only sufficient stretch to allow for ease in putting on or removing the garment without adding bulk at the waist to thicken the body, and in achieving wide leg openings for the admission of air.

It will be noted that the lower edges of all panels are curved, this being conventional.

In preferred embodiments, the top of the front panels are slightly wider than one-quarter of the wearer's body circumference.

The width at the lower edge of respective panels or panel portions may vary, but to obtain typical preferred fullness, is a length dimension of about three times the width at the top of those panels or panel portions.

As previously set-forth, the fabric of the present invention must be knit in nature and must be of the type fabric herein referred to as undergarment knit fabric. In order to further understand the exact nature of what, for purposes of this present invention, is intended to be included by that terminology—which is characteristic of the trade, some general discussion is herein given, as follows.

Different yarn size nomenclature is used by different spinning systems to designate the fineness or coarsness of yarn spun under the particular spinning system. For example, the size of yarn spun on the woolen system is called "run." The size of synthetic yarn is generally designated by the term denier which means the number of unit weights of 0.05 grams per 450-meter length (i.e., 1600 yards per lb.(pound), for example).

The straight or lengthwise yarn of the fabric also has different names. In woven fabric, the straight is called "warp" and the cross yarn is called "weft". In warp knitted fabrics, the lengthwise yarn is called "wale" and the horizontal yarn is "course."

In synthetics, a 20 weight denier yarn is a fine yarn, 30 denier is heavier and 40 is still heavier, i.e., the higher the number, the coarser the yarn. Frequently, one denier is used for the wale and a different denier is used for the course. Wale and course are often expressed as a fraction, the upper number of which represents the wale and the lower number, the course.

There are many other factors in production that affect the feel and texture of the fabric. For example, there is a fabric in which the inventor is interested of 30/20 denier which is shrunk in the process of manufacturing, and the fabric becomes heavier per square yard than other fabrics of the same denier not treated in this manner.

Fabric finer than 20/20 is found to be too light and to thin to perform sufficiently well or optimally for the present invention; and above 40/40 is found to be too heavy for utilization of a slip, and thus for the combined-half-slip of the present invention. Thus, the undergarment knit fabric as defined for the present invention is at least as heavy as 20/20 and not more than weight of about 40/40. A preferred denier is 40/20 with a yield of 7 square yards per pound of yarn, thus noting that while over 40/40 is too heavy weight, other combinations of "40" result in lighter and acceptable fabric. Likewise, while below 20/20 is too light weight, other combinations thereof are utilizable. The prefered above-noted 40/20 fabric represents non-shrunk fabric. The previously-noted shrunken fabric of 30/20 yields 5.40 square yards per pound. The undergarment knit fabric includes these bounds.

Light weight dress fabric (not underware) is made of about 70 denier with a 2.91 square yard per pound yield; in contrast, garments such as slacks or other such outer garments would be made of about 70 to 150 denier with varying lesser yields. Accordingly, such fabrics are not in the same category and do not overlap with the bounds above-noted of the undergarment knit fabric of the present invention, and such other fabrics would not have the novel antichafe utility of the antichafe lower undergarment for women, of the construction of the present invention.

Purely for informational purposes, it may be helpful to reiterate here, that "true" bias of fabric is a line at a 45 degree angle to the lengthwise or wale of the fabric. The term "bias" is also used for a diagonal line even though it is less or greater than 45 degrees angle to the wale, and it is in this latter sense that the term "bias" has been used in this disclosure.

Again, for informational purposes, the classical definition of denier is—a weight-per-unit length measure of any linear material. Officially, it is the number of unit weights of 0.05 grams per 450-meter length. This is numerically equal to weight in grams of 9,000 meters of the material. Denier is a direct numbering system in which the low numbers represent the finer sizes and the higher numbers represent the coarser sizes. In the U.S., the denier system has to some extent been replaced by the tex system.

With further reference to the illustrated embodiments, the FIGS. 1A, 1B, 1C, 2, and 3 represent one preferred embodiment of the antichafe lower undergarment 4, whereas the FIGS. 1B', 1C' and 3' represent an alternate less-preferred embodiment.

However, the functional parts of both above-noted embodiments are substantially identical and accordingly numeral and indicia representing one embodiment are likewise utilized to illustrate the other except for the placing of a "prime" with the number of the embodiment of FIGS. 1B', 1C' and 3', such as **5*a*' for this embodiment as compared to 5*a* for the embodiment of FIGS. 1A, 1B, 1C, 2 and 3, for example. Accordingly, for the elements and functions described with regard to the preferred embodiment of FIGS. 1A, 1B, 1C, 2 and 3, description is not hereinafter repeated for the FIGS. 1B', 1C' and 3'** because to do so would be redundant.

Thus, with regard to the preferred embodiment of FIGS. 1A, 1B, 1C, 2 and 3, the description is as follows.

Figure 2:
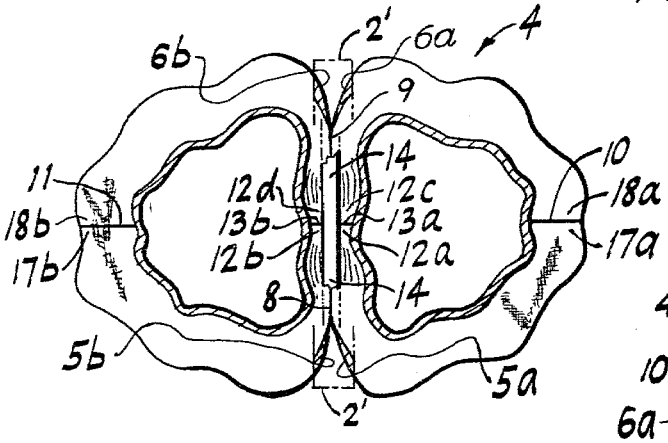
FIG. 2 illustrates a cross-sectional view as taken along line 2—2 and 2'—2', of FIG. 1.

There is shown an antichafe lower undergarment 4 which is a composit of basically four separate panels. Those panels are panels **5*b* (front first panel), 5*a* (front second panel), 6*b* (rear third panel), and 6*a* (rear fourth panel). The panel 5*b* has a first right upright seam edge extending between the points 12*b* and 15*b*. The panel 6*b* likewise has a first right upright seam edge extending between points 12*d* and 16*b*. The panel 5*b* has a first left upright seam edge extending between points 22*a* and 17*b*; likewise the panel 6*b* has a first left upright seam edge extending between points 22*b* and 18*b*. In corresponding manner, the panel 5*a* has a second left upright seam edge extending between points 12*a* dna 15*a*, and has a second right upright seam edge extending between points 21*a* and 17*a*; likewise, the panel 6*a* has a second left upright seam edge extending between points 12*c* and 16*a* and a second right upright seam edge extending between points 22*a* and 18*a*. The panels 5*b* and 6*b* respectively have concavely-shaped arcuate edges 30*b* and 29*b* respectively, and panels 5*a* and 6*a* respectively have concavely-shaped arcuate edges 30*a* and 29*a* respectively. When sewn into an assembled composite, the unification seam between front first right upright seam edge and rear first right upright seam edge becomes a first seam 13*b*. Unification seam between the front second left upright seam edge and rear second left upright seam edge becomes a second seam 13*a*. Unification seam between 30*b* and 30*a* edges becomes a third seam 8. Unification seam between edges 29*b* and 29*a* becomes a fourth seam 9. Unification between front first left upright seam edge and rear first left upright seam edge becomes a fifth seam 11, and unification between front second right upright seam edge and rear second right upright seam edge becomes a seam 10. Each of points 12*a*, 12*b*, 12*c*, and 12*d* are brought together and joined as shown in FIG. 2**.

The top of the center lines seam 8 (the third seam 8) and seam 9 (the fourth seam 9) constitutes the beginning points for each of the center lines of the four panels, which centerline is for purposes of illustration as an imaginary line illustrates solely for the panel **5*b*, as centerline 26. It is between this centerline 26 and the wale (fabric wale line) line 25 that the angle 24** of cut, off the bias is illustrated.

Mounted in the top of the stitched garment as shown in FIGS. 1A and 1B and 1C, there is an annularly-stitched elastic band 7.

Extending between the top centerline point at the top of the fourth seam, to the top centerline point at the top of the third seam, there is mounted (such as being sewn) the reinforcement tape 14.

As seen in the illustrated embodiments, each of the panels **5*b*, 5*a*, 6*b*, and 6*a* are fabric cut as panels of elongated shap from top to bottom; in effect, the same is true for the panel portions 5*b*', 5*a*', 6*b*' and 6*a*' of the FIGS. 1B' and 1C' and 3'** embodiment.

For purposes of facilitating understanding as to which edges are brought together in the FIG. 3 illustration to result in the undergarment of FIGS. 1A, 1B and 1C, there are shown in the FIG. 3 connection-lines such as 33*a*, 33*c*, 32*a*, 32*b*, 33*b*, 33*d*, and the like (not all lines are numbered, but illustrate the points that are brought together in assemblage before seaming).

While such is purely ornamental, there is illustrated also the conventional bottom lace 31.

It will be seen in the FIGS. 1B' and 1C' and 3' that for that embodiment, there are no side-seams, and that the front panel portions and rear panel portions for each of the mirror image bilateral two panels, and that instead of side seams, the front and rear panel portions for each bilateral panel are unitary, i.e. unitaryily the front and rear panel portions are cut simultaneously as a unitary part of a common fabric undivided between those portions. Otherwise, this embodiment is the same as the preferred embodiment, except that in this embodiment the wale and cut relative thereto for either the front or the rear panel portions would differ considerably from the cut off of the bias of the other panel portion thereof. Normally the preferred off the bias angle of cut would apply to the front panel portion and there would be a shorter top-to-bottom length cut for the rear panel portions in order to allow for and compensate for immediate and future stretch of the undergarment knit fabric.

It is within the spirit and scope of the invention to make such variations and substitution of equivalents as would be obvious to a person of ordinary skill in this art.

I claim:

1. An antichafe lower undergarment comprising in combination: a composite of first and second pairs of panels of undergarment knit fabric of elongated shape from top to bottom, and said first pair including first and second panels that are mirror-images of each other in shape and being front panels, said second pair including third and fourth panels that are mirror-images of each other and being rear panels, each of said front first panel and said rear third panel having first right and first left upright seam edges, each of said front second panel and rear fourth panel having second right and second left upright seam edges, and said front first panel and said rear third panel each having first and second concavely-shaped arcuate edges extending between an upper portion of said first right upright seam edge and said top of said front first panel and extending between an upper portion of said second right upright seam edge and said top of said rear third panel respectively, and said front second panel and said rear fourth panel having third and fourth concavely-shaped arcuate edges extending between an upper portion of said second left upright seam edge and said top of said front second panel and extending between an upper portion of said fourth left upright seam edge and said top of said rear fourth panel, each of said first, second, third and fourth concavely-shaped arcuate edges being joined together at a lower end of each thereof, and said front first panel's first right edge and said rear third panel's first right edge being seamed together along their lengths as a first seam, and said front second panel's second left edge and said rear fourth panel's second left edge being seamed together along their lengths as a second seam, and said first and third concavely-shaped arcuate edges being seamed together along their lengths as a third seam, and said second and fourth concavely-shaped arcuate edges being seamed together along their lengths as a fourth seam, and said front first panel's first left upright seam edge and said rear third panel's first left upright seam edge being seamed together along their lengths as a fifth seam, and said front second panel's second right upright seam edge and said rear fourth panel's second right upright seam edge being seamed together along their lengths as a sixth seam, and from an upper-most location of each of said third seam and said fourth seam, there being imaginary lines each extending downwardly along a surface each of said first, second, third and fourth panels and said imaginary lines being respectively first, second, third and fourth centerlines respectively of said first, second, third and fourth panels, and relative to said first, second, third and fourth centerlines respectively the first, second, third and fourth panels respectively being cut at an angle ranging from about 105 degrees to about 125 degrees off grain of said undergarment knit fabric.

2. An antichafe lower undergarment of claim 1, including a reinforcing tape extending over seam lines of said third seam and of said fourth seam, seamed thereto.

3. An antichafe lower undergarment of claim 2, in which said third and fourth concavely-shaped arcuate edges are of greater length than said first and second concavely-shaped arcuate edges.

4. An antichafe lower undergarment of claim 1, in which said third and fourth concavely-shaped arcuate edges are of greater length than said first and second concavely-shaped arcuate edges.

5. An antichafe lower undergarment of claim 4, in which said angle ranges from about 110 degrees up to about 120 degrees.

6. An antichafe lower undergarment comprising in combination: a composite of first and second pairs of panels of undergarment knit fabric of elongated shape from top to bottom, said first pair including first and second panels that are mirror-images of each other in shape and being front panels, said second pair including third and fourth panels that are mirror-images of each other and being rear panels, each of said front first panel and said rear third panel having first right and first left upright seam edges, each of said front second panel and rear fourth panel having second right and second left upright seam edges, and said front first panel and said rear third panel each having first and second concavely-shaped arcuate edges extending between an upper portion of said first right upright seam edge and said top of said front first panel and extending between an upper portion of said second right upright seam edge and said top of said rear third panel respectively, and said front second panel and said rear fourth panel having third and fourth concavely-shaped arcuate edges extending between an upper portion of said second left upright seam edge and said top of said front second panel and extending between an upper portion of said fourth left upright seam edge and said top of said rear fourth panel, each of said first, second, third and fourth concavely-shaped arcuate edges being joined together at a lower end of each thereof, and said front first panel's first right edge and said rear third panel's first right edge being seamed together along their lengths as a first seam, and said front second panel's second left edge and said rear fourth panel's second left edge being seamed together along their lengths as a second seam, and said first and third concavely-shaped arcuate edges being seamed together along their lengths as a third seam, and said second and fourth concavely-shaped arcuate edges being seamed together along their lengths as a fourth seam, and said front first panel's first left upright seam edge and said rear third panel's first left upright seam edge being seamed together along their lengths as a fifth seam, and said front second panel's second right upright seam edge and said rear fourth panel's second right upright seam edge being seamed together along their lengths as a sixth seam, and in which said third and fourth concavely-shaped arcuate edges are of greater length than said first and second concavely-shaped arcuate edges.

7. An antichafe lower undergarment comprising in combination: a composite of first and second panels of undergarment knit fabric each having a top and a bottom, said first panel including first and third panel portions folded-over in semicircular form with the third panel portion located substantially behind the first panel portion, and said second panel including second and fourth panel portions folded-over in semicircular form with the fourth panel portion located substantially behind the second panel portion, said first and second panels being mirror-images of each other in shape, and said first and second panel portions being front panel portions, and said third and fourth panel portions being rear panel portions, said front first panel portion and said rear third panel portion respectively each having a front right and a rear right upright edge respectively, said front second panel portion and said rear fourth panel portion respectively having a front left and a rear left upright seam edge respectively, and said front first panel portion and said rear third panel portion each having first and second concavely-shaped arcuate edges extending between an upper portion of said front right upright edge and said top of said front first panel portion and extending between an upper portion of said rear right upright edge and said top of said rear third panel portion respectively, and said front second panel portion and said rear fourth panel portion having third and fourth concavely-shaped arcuate edges extending between an upper portion of said front left upright edge and said top of said front second panel portion and extending between an upper portion of said rear left upright edge and said top of said rear fourth panel portion, each of said first, second, third and fourth concavely-shaped arcuate edges being joined together at a lower end of each thereof, and said front first panel portion's front right edge and said rear third panel portion's rear right edge being seamed together along their lengths as a first seam, and said front second panel portion's front left edge and said rear fourth panel portion's rear left edge being seamed together along their lengths as a second seam, and said first and third concavely-shaped arcuate edges being seamed together along their lengths as a third seam, and said second and fourth concavely-shaped arcuate edges being seamed together along their lengths as a fourth seam.

8. An antichafe lower undergarment of claim 7, in which widths of said first and second panels respectively are sufficiently larger at said bottom than at said top, that a full flared skirt exists providable of a fullness of drape when worn.

9. An antichafe lower undergarment of claim 6, in which widths of said first, second, third and fourth panels respectively are sufficiently larger at said bottom than at said top, that a full flared skirt exists providable of a fullness of drape when worn.

10. An antichafe lower undergarment of claim 1, in which widths of said first, second, third and fourth panels respectively are sufficiently larger at said bottom than at said top, that a full flared skirt exists providable of a fullness of drape when worn.

* * * * *